US011286147B2

(12) United States Patent
Woo et al.

(10) Patent No.: US 11,286,147 B2
(45) Date of Patent: Mar. 29, 2022

(54) HOT-LIQUID SUPPLY DEVICE AND METHOD FOR CONTROLLING SAME

(71) Applicant: LG ELECTRONICS INC., Seoul (KR)

(72) Inventors: Sangki Woo, Seoul (KR); Myounghoon Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/259,688

(22) PCT Filed: May 31, 2019

(86) PCT No.: PCT/KR2019/006574
§ 371 (c)(1),
(2) Date: Jan. 12, 2021

(87) PCT Pub. No.: WO2020/013445
PCT Pub. Date: Jan. 16, 2020

(65) Prior Publication Data

US 2021/0130151 A1 May 6, 2021

(30) Foreign Application Priority Data

Jul. 13, 2018 (KR) ..... 10-2018-0081391

(51) Int. Cl.
*B67D 1/12* (2006.01)
*B67D 1/00* (2006.01)
*B67D 1/08* (2006.01)

(52) U.S. Cl.
CPC ..... *B67D 1/1202* (2013.01); *B67D 1/0014* (2013.01); *B67D 1/0888* (2013.01); *B67D 1/0895* (2013.01)

(58) Field of Classification Search
CPC .... B01D 35/18; B67D 1/0014; B67D 1/0888; B67D 1/0895; B67D 1/1202
See application file for complete search history.

(56) References Cited

U.S. PATENT DOCUMENTS 9,622,615 B2 * 4/2017 Hecht ..... B67D 1/0081
9,856,126 B2 * 1/2018 Jeon ..... B67D 1/0014
(Continued)

FOREIGN PATENT DOCUMENTS

KR 10-2015-0008018 1/2015
KR 10-2017-0034856 3/2017
(Continued)

OTHER PUBLICATIONS

U.S. Appl. No. 17/259,697, filed Jan. 12, 2021.
(Continued)

*Primary Examiner* — Timothy L Maust
(74) *Attorney, Agent, or Firm* — Ked & Associates, LLP

(57) ABSTRACT

The present invention provides a hot-water supply device comprising: a flow control valve for controlling the flow rate of water supplied from the outside; a heating module for heating water passed through the flow control valve and guided thereto; a hot-water discharge valve for opening or closing a channel through which the water heated by the heating module is discharged; an input unit for receiving a hot-water discharge signal; and a controller for controlling the flow control valve, the heating module, and hot-water discharge valve such that the flow rate of water supplied to the heating module is controlled step by step by the flow control valve according to signals received by the input unit.

20 Claims, 13 Drawing Sheets

(56) References Cited

U.S. PATENT DOCUMENTS

| | | | | |
|---|---|---|---|---|
| 9,884,354 | B2 * | 2/2018 | Forte | B67D 1/0895 |
| 10,183,853 | B2 * | 1/2019 | Jurczyszak | B67D 1/0895 |
| 10,266,381 | B2 * | 4/2019 | Kim | B67D 1/0895 |
| 10,549,977 | B2 * | 2/2020 | Kim | B67D 1/0884 |
| 10,894,727 | B2 * | 1/2021 | Yu | E03C 1/044 |
| 10,926,991 | B2 | 2/2021 | Shin et al. | |
| 10,947,101 | B2 * | 3/2021 | Asami | A47J 31/46 |
| 11,057,965 | B2 * | 7/2021 | Kim | B67D 3/0041 |
| 2017/0325294 | A1 | 11/2017 | Kim et al. | |
| 2018/0057344 | A1 * | 3/2018 | Shin | F24H 9/2028 |
| 2018/0354776 | A1 * | 12/2018 | Lee | B01D 35/005 |
| 2021/0030197 | A1 * | 2/2021 | Vetterli | A47J 31/542 |

FOREIGN PATENT DOCUMENTS

| | | |
|---|---|---|
| KR | 10-2017-0125451 | 11/2017 |
| KR | 10-2017-0125561 | 11/2017 |
| WO | WO 2016/186343 | 11/2016 |

OTHER PUBLICATIONS

International Search Report and Written Opinion dated Sep. 9, 2019 issued in Application No. PCT/KR2019/006571 (with English Translation).

International Search Report and Written Opinion dated Sep. 20, 2019 issued in Application No. PCT/KR2019/006574 (with English Translation).

United States Office Action dated Nov. 26, 2021 issued in co-pending related U.S. Appl. No. 17/259,697.

* cited by examiner

HOT-LIQUID SUPPLY DEVICE AND METHOD FOR CONTROLLING SAME

CROSS-REFERENCE TO RELATED PATENT APPLICATIONS

This application is a U.S. National Stage Application under 35 U.S.C. § 371 of PCT Application No. PCT/KR2019/006574, filed May 31, 2019, which claims priority to Korean Patent Application No. 10-2018-0081391, filed Jul. 13, 2018, whose entire disclosures are hereby incorporated by reference. This application is also related to U.S. patent application Ser. No. 17/259,697, filed on Jan. 12, 2021, which is a U.S. National Stage Application under 35 U.S.C. § 371 of PCT/KR2019/006571, filed May 31, 2019, which claims priority to Korean Patent Application No. 10-2018-0081392, filed Jul. 13, 2018, whose entire disclosures are hereby incorporated by reference.

TECHNICAL FIELD

The present disclosure relates to a hot water supply apparatus and a method for controlling the same, and more particularly, to a hot water supply apparatus capable of stably providing hot water to a user and a method for controlling the same.

BACKGROUND ART

A drinking water supply apparatus refers to an apparatus that supplies drinking water for a user to drink. The drinking water supply apparatus may be a stand-alone apparatus, or may constitute a part of another apparatus. A water purifier, which is a type of drinking water supply apparatus, is an apparatus configured to supply purified water to a user by filtering raw water supplied from a faucet through a separate filtering means. In addition, an apparatus configured to supply purified water as cold or hot water when a user needs it may also be referred to as a water purifier. The water purifier may be an apparatus independent of other home appliances.

The drinking water supply apparatus includes a hot water supply apparatus capable of providing hot water to a user. That is, an apparatus that has a function of supplying hot water among drinking water supply apparatuses may be considered as a hot water supply apparatus.

Hot water supplied to the user through such a hot water supply apparatus must be maintained within a specific temperature range. When the temperature of the hot water is low, the user tends to perceive that the hot water supply apparatus malfunctions.

Hot water is produced by heating water by a heater. If the heater is kept turned on even when the user does not need hot water, energy will wasted. Therefore, the heater may be driven whenever hot water is needed, and a temperature deviation of the supplied hot water may occur depending on the time at which the hot water is supplied. Therefore, it is necessary to reduce the temperature deviation.

DISCLOSURE

Technical Problem

An object of the present disclosure devised to solve the above problems is to provide a hot water supply apparatus for providing hot water having an appropriate temperature to a user and a control method thereof.

Another object of the present disclosure is to provide a hot water supply apparatus for supplying hot water to a user by determining a time when hot water is provided, and a control method thereof.

Technical Solution

When a water purifier including a hot water supply apparatus provides hot water to a customer, it may be difficult to meet a similar temperature in the case of recurring dispensing of water depending on the input water temperature and the surrounding environment. Therefore, in order to improve the performance of recurring dispensing of hot water and secure a desired temperature, water in a flow passage may be drained through a valve having a drainage function for a set period of time after a certain period of time to drain the existing water remaining in a pipe to raise the temperature of the flow passage and suppress occurrence of heat exchange in dispensing hot water.

In the case of recurring dispensing of water heated once after the first dispensing of water, the flow rate of hot water provided to the user may increase even though the output power of the heating module decreases compared to that in the first dispensing. To address this issue in the present disclosure, the temperature of hot water to be dispensed is satisfied by flexibly applying the existing draining time within a certain range after the hot water is dispensed.

In the recurring dispensing of water after the first dispensing, the temperature in the flow passage through which water flows gradually decreases over a certain period of time. In recurring dispensing of water provided to the user, the flow rate may be higher and the output power of the heater may be lower than in the first dispensing, and thus a separate effort may be required to increase the dispensed water temperature. Therefore, in providing recurring dispensing of water, the water in the flow passage may be drained with the drain valve for a certain period of time after a certain period of time and the flow rate may be changed to increase the temperature of hot water of the water purifier in the recurringly dispensing.

In order to improve the recurring dispensing performance of hot water, water in the flow passage may be drained for a set time through a valve that has a drainage function after a certain period of time, and the existing water remaining in the pipe may be drained. Thereby, when hot water is dispensed, the temperature of the flow passage may be raised, and the occurrence of heat exchange between the water and the pipe of the flow passage may be reduced. Accordingly, the temperature of hot water provided to the user may be increased.

In the case of recurring dispensing in which the flow passage has been heated once after the first dispensing, the output power in the preheating, fixing, and PI sections may be reduced compared to the first dispensing. In addition, when the flow rate is adjusted to a higher rate, the temperature of hot water may become lower than the temperature of hot water supplied in the first dispensing.

In the present disclosure, when a recurring dispensing algorithm is started after the end of the first dispensing of water, it is determined whether the dispensing is recurring dispensing within 3 minutes. The flow rate may be changed from a primary target flow rate of 430 gpm to a secondary target flow rate of 400 gpm to reduce the flow rate by multi-stage flow control in a PI section where the output power is increased. Thereby, the temperature of dispensed water may be increased.

In the present disclosure, it is determined whether the dispensing is recurring dispensing after 3 minutes or more, and the flow rate may be changed from a primary target flow rate of 430 gpm to a secondary target flow rate of 400 gpm to further reduce the flow rate by multi-stage flow control in the PI section where the output power is increased. Thereby, the temperature of dispensed water may be increased.

In an aspect of the present disclosure, provided herein is a method for controlling a hot water supply apparatus. The method may include a first operation of receiving a hot water dispensing signal, a second operation of determining whether corresponding dispensing is first dispensing or recurring dispensing, and a third operation of providing a user with hot water using a first dispensing provision algorithm when the corresponding dispensing is the first dispensing, or using a recurring dispensing provision algorithm when the corresponding dispensing is the recurring dispensing, wherein, in the third operation, an amount of water supplied to a heating module configured to heat the water may be adjusted in stages.

In another aspect of the present disclosure, provided herein is an apparatus for supplying hot water. The apparatus may include a flow rate control valve configured to adjust a flow rate of water supplied from outside; a heating module configured to receive water passing through the flow rate control valve and guided thereto and to heat the water; a hot water dispensing valve configured to open and close a flow passage through which the water heated by the heating module is discharged; an input unit configured to receive a signal for dispensing of hot water; and a controller configured to control the flow rate control valve, the heating module, and the hot water dispensing valve and to adjust a flow rate of water supplied from the flow rate control valve to the heating module in stages according to the signal received through the input unit.

The apparatus may further include a drain valve disposed in a flow passage connecting the heating module and the hot water dispensing valve and configured to open and close a flow passage through which water is discharged to the outside without passing through the hot water dispensing valve.

Advantageous Effects

According to the present disclosure, hot water having an appropriate temperature may be provided to a user. In particular, when the user cause hot water to be dispensed again a certain time after discharging the hot water, the temperature of the provided hot water may be increased to satisfy the user.

In addition, according to the present disclosure, the temperature of hot water provided to the user may be increased regardless of the temperature of water supplied to the hot water supply apparatus or the surrounding environment.

Further, according to the present disclosure, the temperature of water provided to the user may be kept constant by variously changing the amount of water supplied, the amount of water drained, and the like according to the time when the user wants hot water to be dispensed.

BEST MODE

Figure 1:
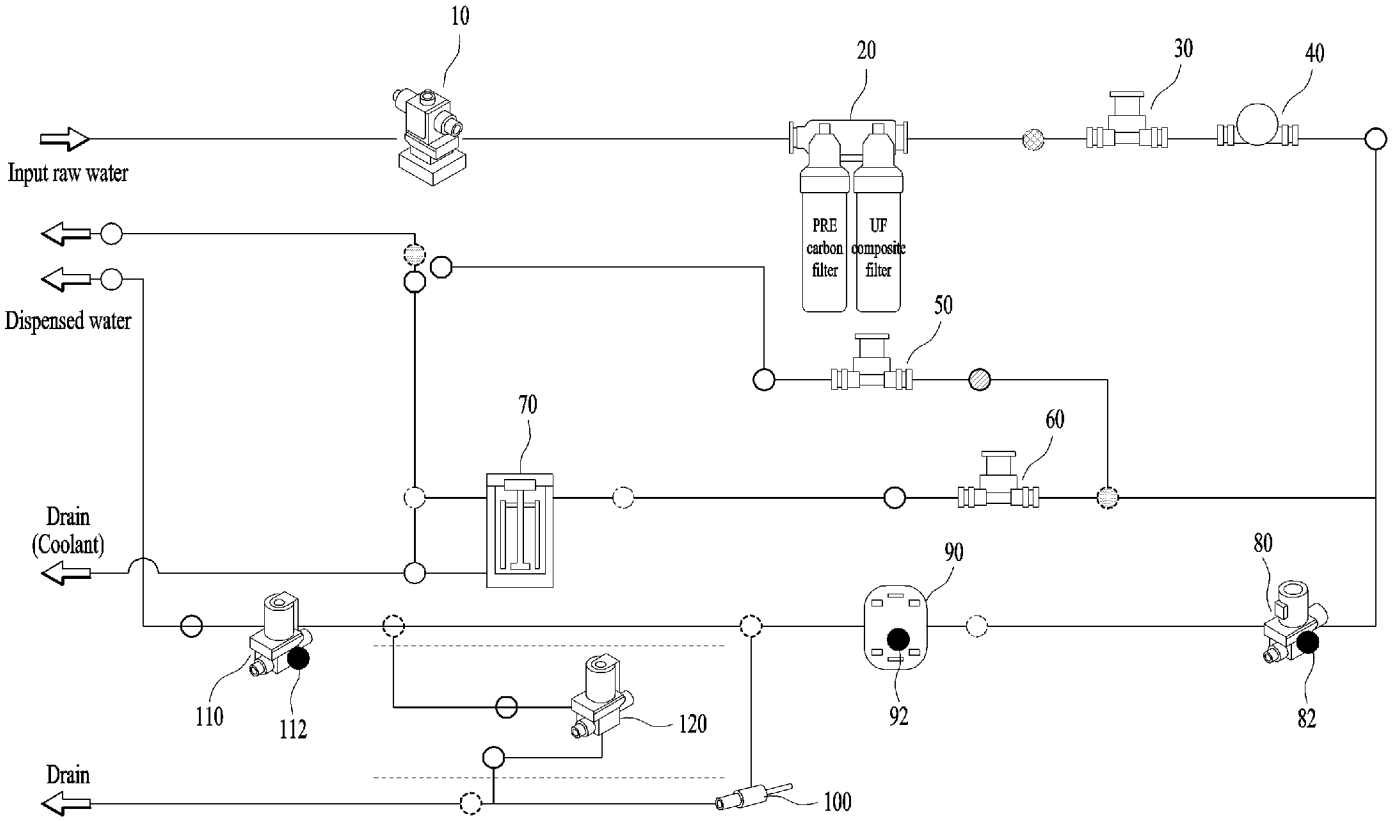
FIG. 1 is a diagram illustrating water piping according to an embodiment of the present disclosure.

Hereinafter, exemplary embodiments of the present disclosure that may specifically realize the above-mentioned objects will be described with reference to the accompanying drawings.

The sizes and shapes of the components shown in the drawings may be exaggerated for clarity and brevity. In addition, terms defined in consideration of the configuration and operation of the present disclosure may be changed depending on the intention of a user or an operator, or practices. Definitions of such terms should be made based on the contents throughout this specification.

A water pipe diagram of a hot water supply apparatus will be described with reference to FIG. 1.

As shown in FIG. 1, individual components may be connected to each other by a pipe through which water passes. Thus, water may move through the individual components and then be finally supplied to a user.

When water is supplied from the outside, it passes through a pressure reducing valve 10, which is configured to reduce the pressure of the water. Foreign substances in the water having passed through the pressure reducing valve 10 may be filtered out while the water passes through a filter 20. The filter 20 may include a pre-carbon filter and a UF composite filter. The pre-carbon filter and the UF composite filter may constitute one assembly and may be individually replaced according to a usage period.

The water that has passed through the filter 20 passes through a feed valve 30 and then passes through a flow rate sensor 40. Since the flow rate sensor 40 is capable of measuring the amount of water passing therethrough, a specific amount of water may be supplied to the inside.

When the user wants purified water having a room temperature to be discharged, the purified water dispensing valve 50 opens a flow passage. Once the purified water dispensing valve 50 opens the flow passage, water passing through the flow rate sensor 40 may be provided to the user, passing through the purified water dispensing valve 50. The water that has passed through the purified water dispensing valve 50 is water from which foreign substances and the like have been filtered out by the filter 20.

When the user wants to cold water having a temperature lower than the room temperature to be dispensed, the cold water dispensing valve 60 opens a flow passage. Once the cold water dispensing valve 60 opens the flow passage, the water that has passed through the flow rate sensor 40 may be guided to the cold water module 70 so as to be cooled. The cold water module 70 may cool water passing through the inside by a refrigerant cooled by a compressor or the like. Alternatively, water may be cooled while passing through a tank that has been cooled by a thermoelectric element. Cold water cooled while passing through the inside of the cold water module 70 may be provided to the user.

In the cold water module 70, a flow passage through which a coolant may move may be formed such that heat exchange with water passing through the inside may be efficiently performed. The cold water module 70 may also include a drain pipe through which the coolant may be discharged as needed.

When the user wants hot water to be dispensed, the hot water dispensing valve 110 opens a flow passage. At this time, the water that has passed through the flow rate sensor 40 is guided to the flow rate control valve 80. The flow rate control valve 80 may adjust the flow rate at which water passes therethrough. The water that has passed through the flow rate control valve 80 may be heated while passing through the heating module 90. Then, the hot water may be provided to the user through the hot water dispensing valve 110.

A flow passage for guiding water to the drain valve 120 is connected to the flow passage between the heating module 90 and the hot water dispensing valve 110. That is, the water that has passed through the heating module 90 may be provided to the user through the hot water dispensing valve 110 or may be discharged to the outside through the drain valve 120. In other words, when the temperature of the water heated by the heating module 90 is not sufficiently increased, the water may be discharged through the drain valve 120 and may not be provided to the user. Specific relevant embodiments will be described in detail with reference to other drawings.

When the pressure is excessively increased during heating of water by the heating module 90, the pressure may be lowered through the pressure reducing valve 100. Accordingly, heating module 90 may be stably used by preventing excessive pressure from being applied to the heating module 90. The pressure reducing valve 100 may have a structure through which water, steam, air, and the like may be discharged, and may thus lower the pressure of the heating module 90.

Water that has passed through the drain valve 120 or the pressure reducing valve 100 is not provided to the user, but is discharged to the outside through a separate pipe.

The flow rate control valve 80 may be provided with a first temperature sensor 82 to measure the temperature of water passing through the flow rate control valve 80. The first temperature sensor 82 measures the temperature of water before the water is moved to the heating module 90.

The heating module 90 may be provided with a second temperature sensor 92 to measure the temperature of water passing through the heating module 90. The second temperature sensor 92 may measure the temperature of water accommodated in the heating module 90.

The hot water dispensing valve 110 may be provided with a third temperature sensor 112 to measure the temperature of water passing through the hot water dispensing valve 110. The water that has passed through the hot water dispensing valve 110 is finally provided to the user after passing through the connected pipe. Accordingly, the third temperature sensor 112 may measure the final temperature of hot water provided to the user.

Figure 2:
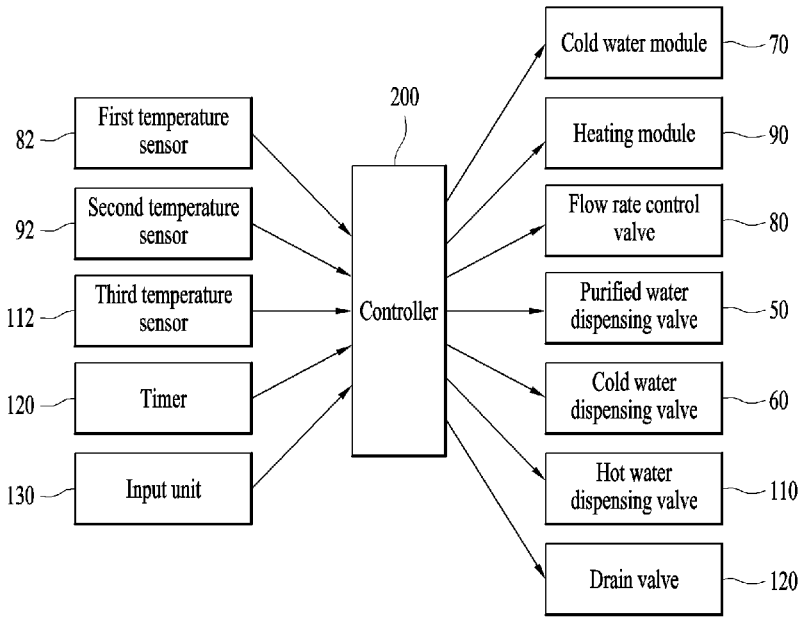
FIG. 2 is a block diagram of components according to FIG. 1.

The components according to FIG. 1 will be described with reference to FIG. 2.

Information about the temperature measured by the first temperature sensor 82, the second temperature sensor 92, and the third temperature sensor 112 is transmitted to the controller 200.

In addition, the elapsed time measured by a timer 120 is transmitted to the controller 200.

The hot water supply apparatus is provided with an input unit 130 through which a user may input a specific command. The input unit 130 may be provided in various forms such as a button type or a touch display type. The user may select dispensing of cold water, purified water, or hot water through the input unit 130. Dispensing of a fixed amount of water may be selected through the input unit 130, and thus the user may be supplied with a predetermined amount of water.

The input unit 130 may be provided with a window through which information may be provided to the user. Information related to the hot water supply apparatus and various kinds of information such as weather may be provided to the user through the window.

The controller 200 may drive the cold water module 70 and the heating module 90 based on various pieces of information received from the above-described components. When the user provides an input that he wants to receive cold water supplied through the input unit 130, the controller 200 may drive the cold water module 70. On the other hand, when the user provides an input that he wants to receive hot water through the input unit 130, the controller 200 may drive the heating module 90. When the user provides an input that he wants to receive purified water through the input unit 130, the controller 200 may not drive any of the heating module 90 and the cold water module 70.

The controller 200 may operate the flow rate control valve 80, the purified water dispensing valve 50, the cold water dispensing valve 60, and the hot water dispensing valve 110 individually. It may open or close the flow passage of each valve.

The flow rate control valve 80 may adjust the flow velocity or flow rate of water guided to the heating module 90 by changing the flow rate of water passing therethrough. The flow rate control valve 80 may increase the flow rate to allow more water to pass therethrough at the same time, or may decrease the flow rate to allow less water to pass therethrough the same time.

When the user inputs dispensing of hot water through the input unit 130, the controller 200 may open the flow rate control valve 80 and open the hot water dispensing valve 110. Then, hot water may be finally provided to the user. Of course, the controller 200 may open the flow rate control valve 80 and the hot water dispensing valve 110 individually or simultaneously.

When the user inputs dispensing of cold water through the input unit 130, the controller 200 opens the cold water dispensing valve 60 to supply cold water to the user.

When the user inputs dispensing of purified water through the input unit 130, the controller 200 opens the purified water dispensing valve 50 to supply purified water obtained through the filter 20 to the user.

The control flow of the present disclosure will be described with reference to FIG. 3.

The user may input a command to dispense any one of hot water, cold water, and purified water on the input unit 130. Hereinafter, a case where the user causes hot water to be dispensed through the input unit 130 will be described in detail.

When the user inputs a command to dispense hot water through the input unit 130, the controller 200 determines whether the time at which the command is input corresponds to the first dispensing or recurring dispensing (S10).

When the time at which the hot water dispensing command is input corresponds to the first dispensing, the controller 200 provides hot water to the user by executing the first dispensing provision algorithm (S30).

On the other hand, when the time at which the hot water dispensing command is input does not correspond to the first dispensing, it is determined that the time corresponds to the recurring dispensing. Thus, the controller 200 provides hot water to the user by executing the recurring dispensing provision algorithm (S50). Of course, a condition for determining that the dispensing is another type of dispensing different from the first dispensing and the recurring dispensing may be added to.

In the present disclosure, in providing hot water to the user, hot water is provided to the user by determining whether the hot water corresponds to the first dispensing or the recurring dispensing.

When the hot water provided to the user corresponds to the first dispensing, this may mean a situation where a long time has elapsed after the user caused hot water to be dispensed, and thus a large amount of time is required to heat the hot water. Specifically, the situation may include a situation in which hot water is dispensed in the morning after hot water was dispensed in the evening.

When the hot water provided to the user corresponds to the recurring dispensing, this may mean a situation where a time has elapsed but is not long as to determine that the dispensing corresponds to first dispensing. Specifically, the situation may include a situation in which hot water has been dispensed before about 30 minutes and hot water is dispensed again.

In the present disclosure, the environment in which hot water is provided to the user is classified into two cases, in consideration of the last time when hot water was dispensed and various conditions. Although the environment is referred to as a condition for determining whether the dispensing is the first dispensing or the recurring dispensing, the term may be changed to various names such as a first condition or a second condition.

In the present disclosure, an algorithm capable of increasing the temperature of hot water is provided in consideration of a situation in which the hot water may not rise to a sufficient temperature in providing hot water to a user.

The process of determining whether the dispensing is the first dispensing in FIG. 3 will be described with reference to FIG. 4.

Figure 4:
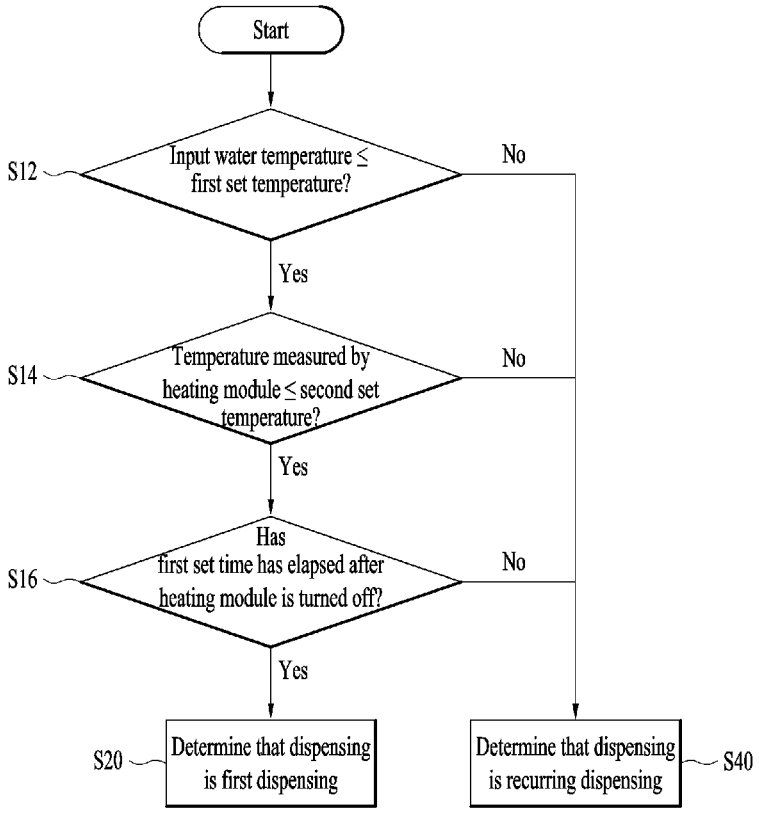
FIG. 4 is a diagram illustrating a process of determining whether dispensing is first dispensing in FIG. 3.

FIG. 4 illustrates a process of determining whether an algorithm for providing the first dispensing is to be applied at the time when the user wants hot water to be dispensed.

First, the user requests dispensing of hot water through the input unit 130.

At that time, it is determined whether the received temperature measured by the first temperature sensor 82 is less than or equal to a first set temperature (S12). Since the temperature of water measured by the first temperature sensor 82 is the temperature of water supplied into the hot water supply apparatus, it is referred to as an input water temperature for simplicity. For example, the first set temperature may mean about 5 degrees Celsius. When the temperature of the water measured by the first temperature sensor 82 is low, it may take a relatively long time to heat water up to the hot water temperature set in the heating module 90. Thus, it is determined whether the temperature of the input water is low.

It is determined whether the water temperature measured by the second temperature sensor 92 is less than or equal to the second set temperature (S14). The second temperature sensor 92 may be installed in the heating module 90 to measure the temperature of water that is accommodated in the heating module 90 or that is introduced into the heating module 90. The second temperature sensor 92 is disposed at a position physically spaced apart from the first temperature sensor 82, and accordingly the hot water supply apparatus may make a determination based on the water temperatures measured at various positions.

The second set temperature may mean about 5 degrees Celsius. 5 degrees Celsius may be an example of a temperature at which it is difficult for the heating module 90 to immediately increase the temperature.

The first set temperature may be set to be equal to or different from the second set temperature.

It is determined whether the heating module 90 does not operate and a first set time has elapsed (S16). Here, the first set time may be about 20 seconds. The heating module 90 may be configured to heat water by an induction heater (IH). When the heating module 90 employs an IH, it may be difficult to heat water to a high temperature instantaneously when the heating module is turned on approximately 20 seconds after it is turned off In FIG. 4, when all three conditions of S12, S14, and S16 are satisfied, it is determined that the environment for providing hot water to the user is the first dispensing (S20). While it is illustrated in FIG. 4 that S12, S14, and S16 are performed in this order, the order of the operations may be changed.

In FIG. 4, when any one of the three conditions of S12, S14, and S16 is not satisfied, it is determined that the environment for providing hot water to the user is the recurring dispensing (S40). That is, when the temperature measured by the first temperature sensor 82 is higher than the first set temperature, the temperature measured by the second temperature sensor 92 is higher than the second set temperature, or the first set time has not elapsed after the heating module 90 is turned off, the controller 200 may determine that the environment corresponds to the recurring dispensing.

Figure 5:
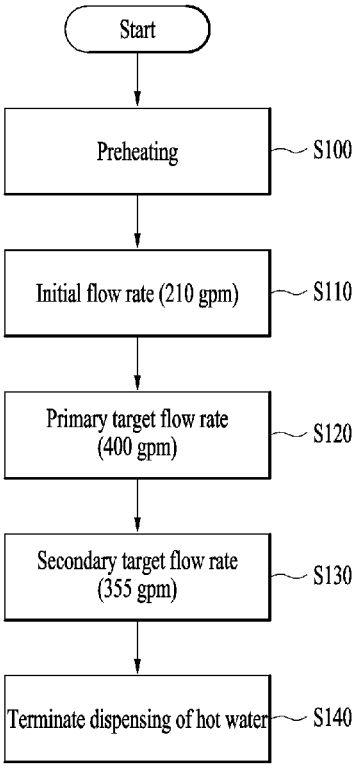
FIG. 5 is a diagram illustrating an embodiment of the first dispensing provision algorithm in FIG. 3.

Referring to FIG. 5, an embodiment of the first dispensing provision algorithm in FIG. 3 will be described.

Figure 3:
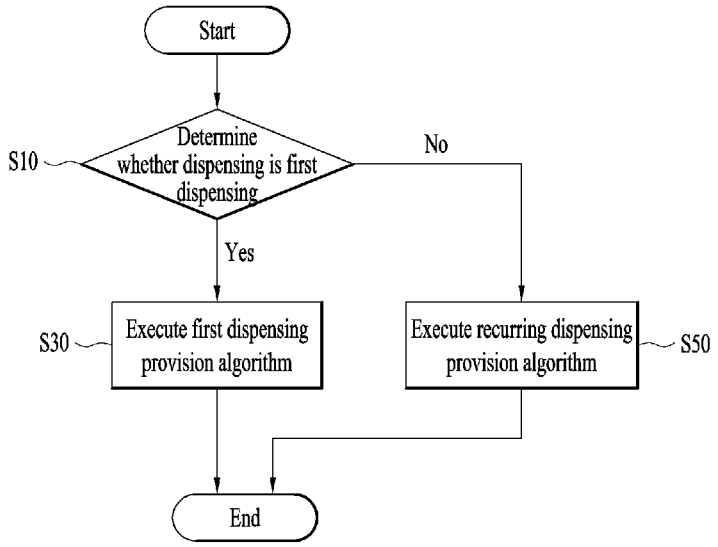
FIG. 3 is a diagram illustrating the control flow of the present disclosure.

When it is determined in FIG. 3 that the time when the user extracts hot water corresponds to the first dispensing, the first dispensing provision algorithm according to FIG. 5 may be executed.

Firstly, when the user inputs a command through the input unit 130 to extract hot water, it is determined whether the input corresponds to the first dispensing. Then, when it is determined that the input corresponds the first dispensing, the hot water dispensing valve 110 keeps the flow passage closed without opening the flow passage.

Then, water is heated with the heating module 90 by driving the heating module 90 (S100).

While the heating module 90 is driven, the hot water dispensing valve 110 opens a flow passage through which water is supplied to the user.

In this case, the process of supplying water from the flow rate control valve 80 to the heating module 90 may be divided into three operations.

The operations included a first supply operation S110 of supplying water to the heating module 90, a second supply operation S120 of supplying water to the heating module 90 after the first supply operation, and a third supply operation S130 of supplying water to the heating module 90 after the second supply operation.

The flow rates of water supplied in the respective supply operations are different from each other.

In the first supply operation, the second supply operation, and the third supply operation, water may be guided to the heating module 90 after passing through the flow rate control valve 80.

Accordingly, by adjusting the flow rate at which water passes through the flow rate control valve 80, the speed of water supplied to the user may be adjusted.

A fixed amount of water supplied from the outside may be maintained by the pressure reducing valve 10, the feed valve 30, and the flow rate sensor 40. In this case, by adjusting the flow rate of water passing through the flow rate control valve 80, the flow rate of water supplied to the heating module 90 is varied.

The lowest flow rate may be given in the first supply operation. Since the heating module 90 may firstly generate relatively little heat, the temperature of the water heated by the heating module 90 may be raised by reducing the first amount of water supplied to the heating module 90. Specifically, in the first supply operation, the flow rate control valve 80 may be operated so as to supply water to the heating module 90 at 210 gpm.

The highest flow rate may be given in the second supply operation. Since the heating module 90 has been driven for a predetermined time, water supplied to the heating module 90 may be heated with the flow rate adjusted to the maximum rate. Specifically, in the second supply operation, the flow rate control valve 80 may be operated to supply water to the heating module 90 at 400 gpm.

In addition, in the third supply operation, the flow rate may be adjusted to be greater than the flow rate in the first supply operation, but to be lower than the flow rate in the third supply operation. In the third supplying operation, the flow rate may be reduced, thereby reducing the speed of water supplied to the heating module 90. Accordingly, the time for heating the water passing through the heating module 90 may increase, and therefore the temperature of the water heated by the heating module 90 may be increased. Specifically, in the second supply operation, the flow rate control valve 80 may be operated to supply water to the heating module 90 at 400 gpm.

The flow rate control valve 80 may increase the temperature of hot water supplied to the user by differently adjusting the flow rate supplied to the heating module 90. Specifically, the flow rate control valve 80 may adjust the flow rate supplied to the heating module 90 in multiple stages. In this embodiment, the details related to controlling the flow rate by the flow rate control valve 80, specifically in three stages, are disclosed.

When the third supply operation is completed, sufficient hot water has been supplied to the user, and thus the flow passage is closed by the hot water dispensing valve 110 and dispensing of hot water is terminated. This operation may be configured to occur about 25 seconds after the user inputs a signal for dispensing hot water through the input unit 130.

Figure 6:
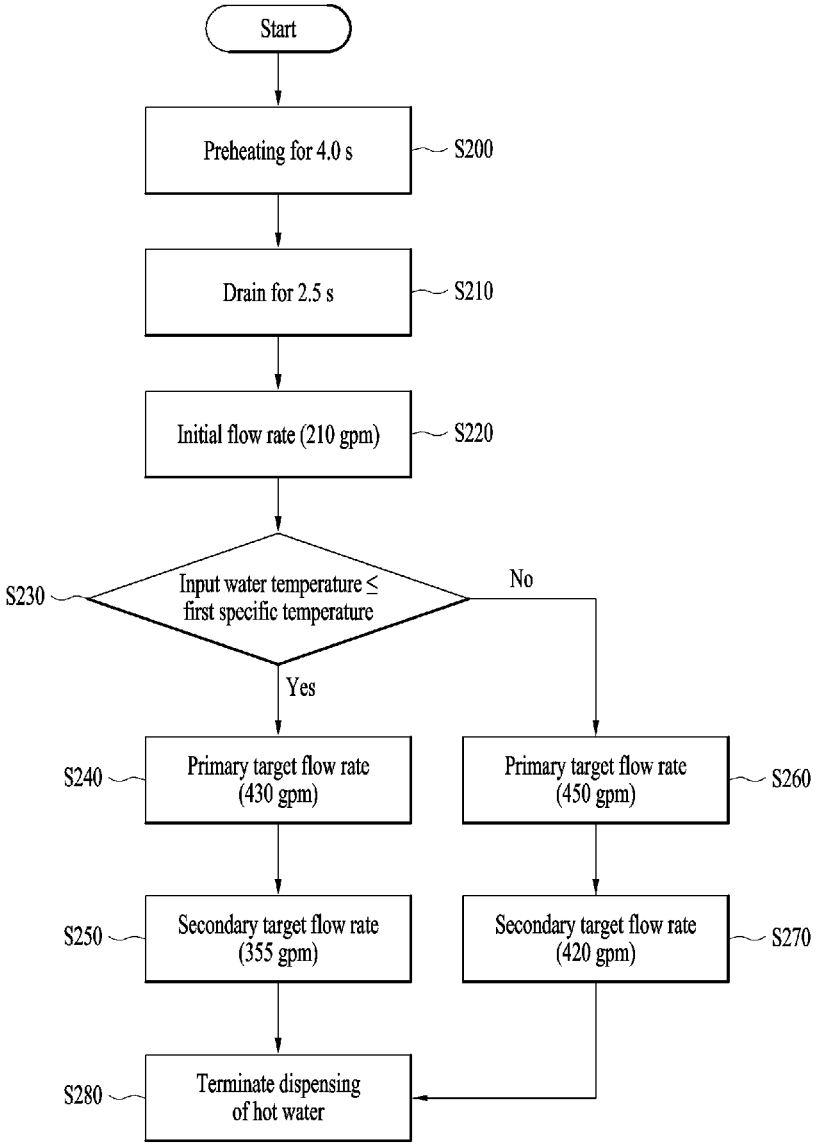
FIG. 6 is a diagram illustrating another embodiment of the first dispensing provision algorithm in FIG. 3.

Another embodiment of the first dispensing provision algorithm in FIG. 3 will be described in detail with reference to FIGS. 6 and 7.

When the controller 200 determines that a hot water dispensing command input by the user corresponds to the first dispensing, the hot water dispensing valve 110 drives the heating module 90 without opening the flow passage. At this time, the heating module is driven for about 4 seconds. During this period of time, the drain valve 120 does not open the flow passage, and thus water accommodated in the heating module 90 or passing through the heating module 90 is not discharged to the outside (S200).

At this time, the heating module 90 performs preheating output. When the heating module 90 employs an IH, electric current is applied to the heating module 90, and heat may be emitted by the heating module 90.

While the heating module 90 is being driven, the drain valve 120 opens the flow passage (S210). Since the hot water dispensing valve 110 does not open the flow passage, hot water is not provided to the user through the hot water dispensing valve 110. However, water passing through the heating module 90 is discharged to the outside through the drain valve 120, and thus the water firstly heated by the heating module 90 through preheating is not supplied to the user.

At this time, the flow rate control valve 80 may allow water to be supplied the heating module 90 with the first flow rate set to 210 gpm (S220). This operation corresponds to the first supply operation described above.

S200 and S210 are sequentially performed, but S220 may be performed before S200. That is, after the flow rate in the flow rate control valve 80 is set to 210 gpm, water may be guided to move to the heating module 90 while S200 and S210 are performed.

The flow rate at which water is supplied thereafter may be changed depending on the temperature measured by the first temperature sensor 82 disposed in the flow rate control valve 80 (S230).

That is, the flow rate of water supplied through the flow rate control valve 80 is controlled differently between the case where the temperature of water measured by the first temperature sensor 82 is lower than or equal to a first specific temperature and the case where the temperature of water is higher than the first specific temperature. Here, the first specific temperature may mean approximately 30 degrees Celsius, but may be changed in various situations.

When the drain operation of S210 (keeping the flow passage open by the drain valve 120) is finished, the hot water dispensing valve 110 may open the flow passage, and thus hot water may start to be supplied to the user. In this case, the drain valve 120 closes the flow passage, and water passes through the flow passage opened by the hot water dispensing valve 110.

Figure 7:
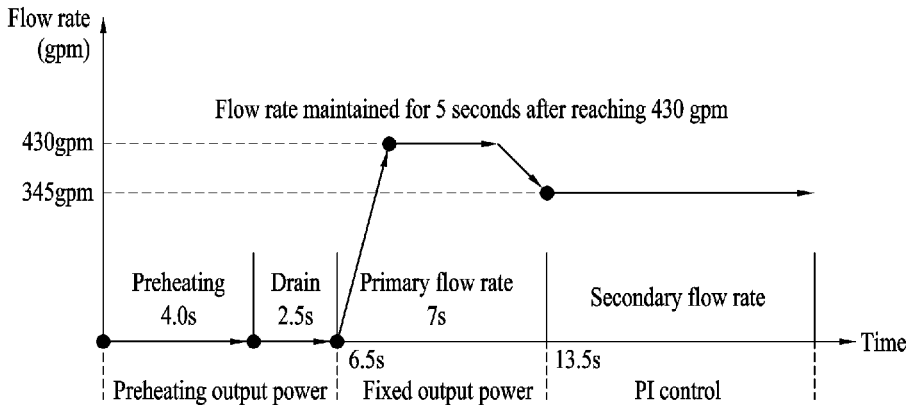
FIG. 7 specifically illustrates another embodiment of FIG. 6.

FIG. 7 illustrates a process corresponding to the case where the temperature measured by the first temperature sensor 82 in S230, that is, the input water temperature is less than the first specific temperature.

In S220, the flow rate control valve 80 allows water to pass therethrough at 210 gpm to move to the heating module 92. Then, in the second supply operation, the flow rate control valve 80 changes the flow rate to 430 gpm (S240).

In this case, when the flow rate is increased to 430 gpm by the flow rate control valve 80, the flow rate is not immediately changed to 430 gpm, but reach the same after a predetermined time elapses. Accordingly, in the second supply operation S240, after reaching the target flow rate of 430 gpm, the increased flow rate is maintained for about 5 seconds.

The heating module 80 may emit heat at a fixed output power after the preheating output operation. By controlling the heating module 80 to generate the fixed output power, water passing through the heating module 90 may be heated.

The heating module 80 may heat water at the fixed output power. The heating may be performed for about 7 seconds.

After the target flow rate of 430 gpm is reached in the flow rate control valve 80, it may be maintained for about 5 seconds. Then, the target flow rate may be lowered to 345 gpm (S250).

Even in this case, it takes a certain amount of time for the flow rate control valve 80 to change the flow rate to a desired flow rate, and the heating module 80 may maintain a fixed output power until the flow rate control valve 80 changes the flow rate to the desired flow rate.

When about 7 seconds elapse as a whole, the flow rate control valve 80 may change the flow rate to the second target flow rate of 345 gpm (S250). At this time, the heating module 90 may increase the temperature to a set temperature through PI control.

In addition, water is supplied to the heating module 90 while the flow rate is maintained by the flow rate control valve 80. The water flowing out from the heating module 90 passes through the hot water dispensing valve 110 and is supplied as hot water to the user.

Once the amount of hot water desired by the user is supplied, the hot water dispensing valve 110 closes the flow passage, and the supply of hot water to the user is stopped (S280).

When the input water temperature, which is the temperature measured by the first temperature sensor 82 in S230, is lower than the first specific temperature, a relatively high flow rate may be controlled by the flow rate control valve 80 while the heating module 90 is controlled at a fixed output power (S260). In this case, the flow rate control valve 80 may guide water to the heating module 90 at approximately 450 gpm.

Since the input water temperature in S260 is higher than in S240, the temperature of hot water provided to the user may be increased even when less heat is supplied from the heating module 90. Accordingly, the flow rate control valve 80 may provide water to the heating module 90 so as to have a higher flow rate.

After S260, the flow rate control valve 80 changes the flow rate of water to a flow rate higher than in S220 and lower than in S260 (S270). At this time, the flow rate control valve 80 controls the water to move to the heating module 90 at 420 gpm.

Then, when the user is supplied with the desired hot water, the dispensing of hot water is terminated (S280).

Figure 8:
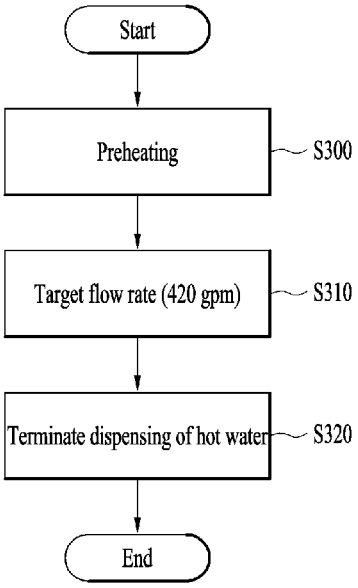
FIG. 8 is a diagram illustrating an embodiment of the recurring dispensing provision algorithm in FIG. 3.

An embodiment of the recurring dispensing provision algorithm in FIG. 3 will be described with reference to FIG. 8.

When the user inputs dispensing of hot water through the input unit 130, it is determined whether the corresponding dispensing is first dispensing or recurring dispensing. When the controller 200 determines that the corresponding dispensing is recurring dispensing, the recurring dispensing provision algorithm is executed.

A preheating operation of driving the heating module 90 is implemented without opening the flow passage of the hot water dispensing valve 110 (S300). That is, while hot water is not supplied to the user through the hot water dispensing valve 110, water is supplied to the heating module 90 through the flow rate control valve 80.

Then, water is supplied from the flow rate control valve 80 to the heating module 90 at a specific target flow rate (S310). The flow rate control valve 80 may control the water to move to the heating module 90 at approximately 420 gpm.

At this time, the hot water dispensing valve 110 opens the flow passage, such that hot water heated by the heating module 90 is provided to the user.

Once the user is supplied with the desired hot water, the hot water dispensing valve 110 closes the flow passage and the dispensing of hot water is terminated (S320).

Another embodiment of the recurring dispensing provision algorithm in FIG. 3 will be described with reference to FIG. 9.

The controller 200 determines that the time at which the user cause hot water to be dispensed corresponds to the recurring dispensing.

Then, the flow rate control valve 80 allows water to move to the heating module 90 while changing the flow rate in multiple stages.

First, the flow rate control valve 80 adjusts the flow rate to match 210 gpm (S400). This operation may represent the first supply operation.

Then, it is determined whether the time at which the user requests dispensing of hot water through the input unit 130 is less than the second set time (S410). The second set time may be about 3 minutes.

Of course, in S410, the hot water dispensing valve 110 may open the flow passage, and it may be determined whether the time when hot water is provided to the user is less than the second set time.

When the time is less than the second set time, the flow rate control valve 80 changes the flow rate to the first target flow rate of 430 gpm (S420). At this time, the water supplied to the heating module 90 increases. In the second supply operation, since a predetermined time has passed after electric current is supplied to the heating module 90, the heating module 90 may provide more heat than in the first supply operation. Therefore, more water may be supplied to increase the amount of hot water provided to the user.

After water is supplied from the flow rate control valve 80 at the target flow rate, the second supply operation is performed (S430). At this time, the flow rate control valve 80 may decrease the flow rate of water supplied to the heating module 90 to a flow rate lower than in S420 and higher than in S400. Since less water is supplied to the heating module 90 than in the second supply operation, the temperature of hot water provided to the user may be increased, and thus satisfaction with the hot water felt by the user may be increased.

Once the amount of hot water desired by the user is provided, the discharge of hot water is terminated (S460).

Even when the time measured by the timer 120 in S410 is less than the second set time, the water supplied to the heating module 90 is adjusted in stages. However, the flow rate allowed by the flow rate control valve 80 is relatively low.

The flow rate control valve 80 may set the primary target flow rate to 430 gpm to set the same flow speed as in S420 (S440).

When a predetermined time elapses after supply at the first target flow rate, the flow rate control valve 80 reduces the target flow rate to 340 gpm (S450). Since the flow rate of water supplied to the user is reduced, the amount of water to be heated in the heating module 90 may be reduced. Accordingly, the temperature of hot water supplied to the user later may increase, and user satisfaction may be enhanced.

Figure 9:
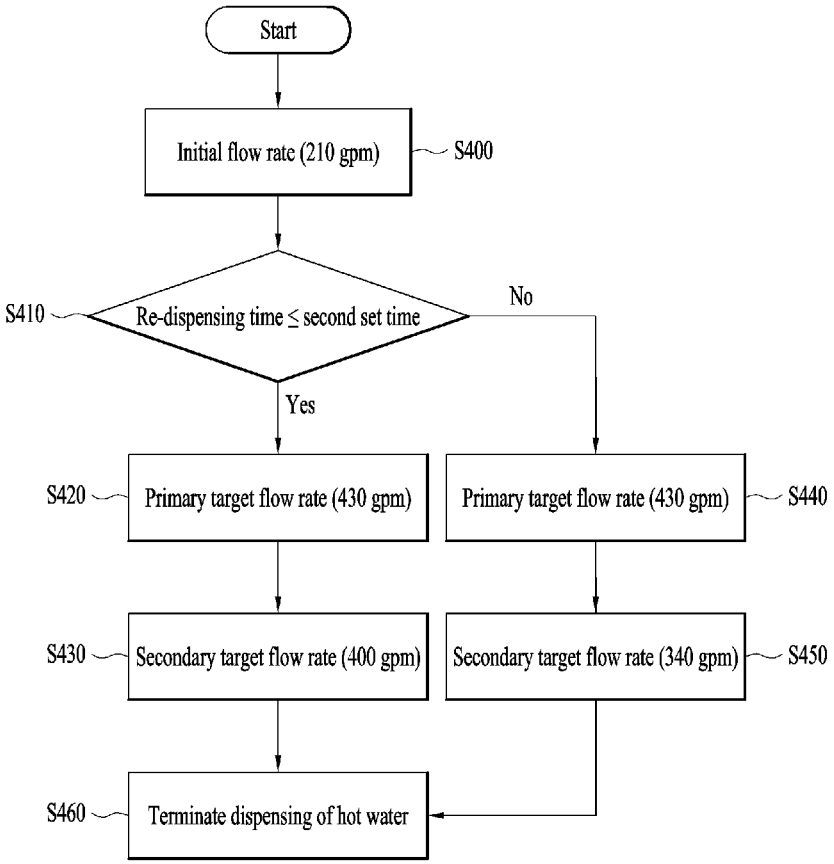
FIG. 9 is a diagram illustrating another embodiment of the recurring dispensing provision algorithm in FIG. 3.

In the process of FIG. 9, the drain valve 120 may close the flow passage, and the hot water dispensing valve 110 may keep the flow passage open, such that hot water may be continuously supplied to the user. That is, in S440 and later operations, hot water is provided to the user through the hot water dispensing valve 110. When S460 is completed, the discharge of hot water is stopped.

Another embodiment of the recurring dispensing provision algorithm in FIG. 3 will be described with reference to FIG. 10.

When the controller 200 determines that the time corresponds to recurring dispensing, the recurring dispensing provision algorithm is executed.

The timer 120 determines whether the time at which hot water is re-dispensed is within the second set time (S500).

When the water re-dispensing time has not passed the second set time, preheating and draining are performed simultaneously for a first specific time (S550). That is, while the heating module 90 is driven, water is heated, and water is drained by the drain valve 120.

At this time, the hot water dispensing valve 110 does not open the flow passage, and thus hot water is not provided to the user.

The water heated by the heating module 90 without opening the flow passage by the hot water dispensing valve 110 for the first specific time is discharged to the outside through the drain valve 120.

When the first specific time elapses, the flow passage is opened by the hot water dispensing valve 110 to provide hot water to the user (S530). At this time, the heating module 90 is driven to heat water and the drain valve 120 closes the flow passage such that water is supplied to the user without being drained. The first specific time may be approximately 0.6 to 1.8 sec.

When the water re-dispensing time is greater than or equal to the second set time in S500, it may be expected that a relatively long time has elapsed since the user causes hot water to be dispensed.

With both the flow passages of the hot water dispensing valve 110 and the drain valve 120 closed, the heating module 90 is driven (S510). That is, the heating module 90 is driven without discharging hot water to the outside. At this time, the heating module 90 is driven for a second specific time. The second specific time may be in the range of approximately 1.8 to 3.9 sec.

Then, it is determined whether the temperature of the hot water measured by the third temperature sensor 112 is higher than the third set temperature (S520). Since the third temperature sensor 112 is disposed in the hot water dispensing valve 110, the temperature is quite similar to that of the hot water supplied to the user.

Accordingly, when the temperature of the water measured by the third temperature sensor 112 increases, the user is supplied with hot water of a high temperature. When the temperature is kept low, the user may be supplied with hot water of a low temperature.

When the temperature measured by the third temperature sensor 112 in S520 is higher than the third set temperature, the hot water dispensing valve 110 opens the flow passage and provides hot water to the user (S530).

On the other hand, when the temperature measured by the third temperature sensor 112 in S520 is lower than or equal to the third set temperature, the drain valve 120 opens the flow passage with the flow passage closed by the hot water dispensing valve 110 (S540).

That is, since the temperature of hot water reaching the hot water dispensing valve 110 after being heated by the heating module 90 is not higher than the third set temperature, it is determined that the temperature of the hot water provided to the user has not sufficiently increased. In addition, it may be expected that the heating module 90 has not supplied heat as to sufficiently heat water.

Accordingly, the hot water passing through the heating module 90 is discharged through the drain valve 120 for a third specific time. Here, the third specific time may be approximately 2.6 to 4.7 sec.

After the hot water heated by the heating module 90 is drained through the drain valve 120 for the third specific time, the hot water dispensing valve 110 opens the flow passage. Then, hot water whose temperature has risen to an appropriate temperature is supplied to the user (S530).

An embodiment according to FIGS. 9 and 10 will be described with reference to FIG. 11.

Figure 10:
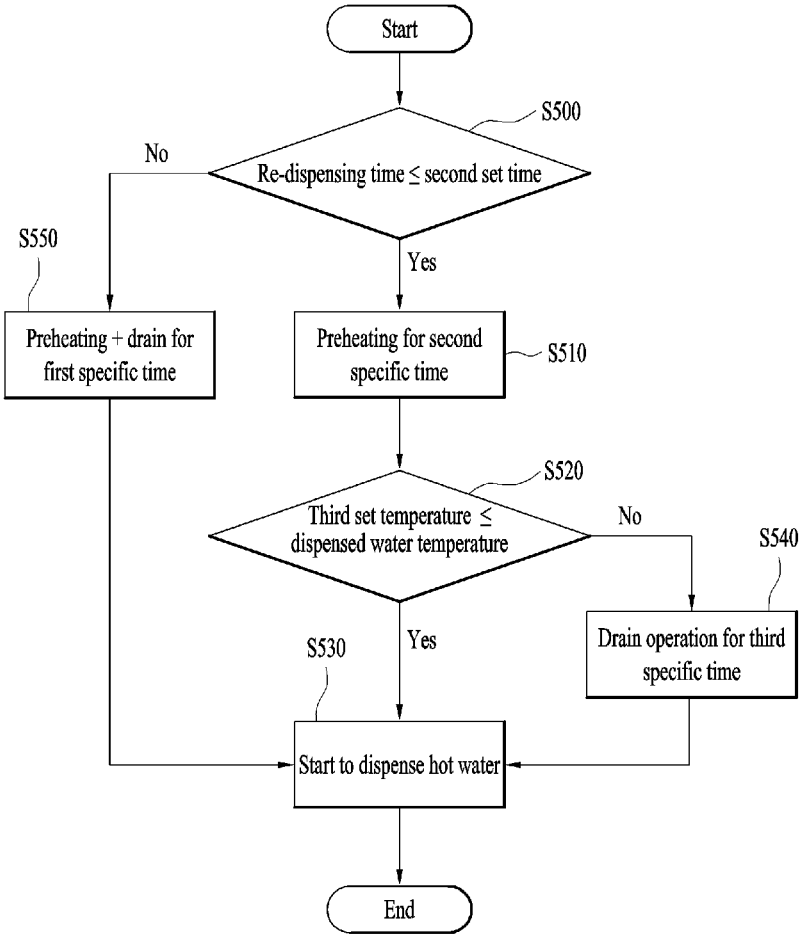
FIG. 10 is a diagram illustrating another embodiment of the recurring dispensing provision algorithm in FIG. 3.
Figure 11:
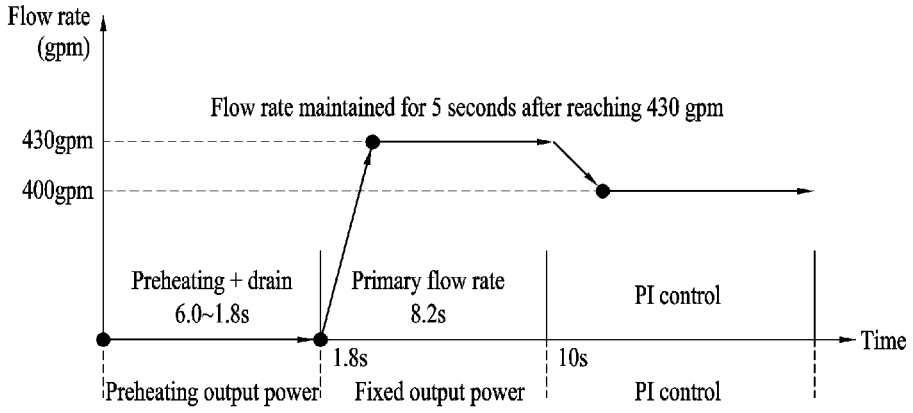
FIG. 11 illustrates an embodiment according to FIGS. 9 and 10.

In the method of FIG. 11, the operations illustrated in FIGS. 9 and 10 are implemented together. This is a case where the controller 200 determines that the corresponding dispensing is recurring dispensing and determines that the water re-dispensing time is within the second set time.

When a hot water re-dispense signal is generated by the user, water is heated by driving the heating module 90. In addition, the drain valve 120 opens the flow passage to discharge water heated by the heating module 90 to the outside through the drain valve 120.

At this time, the heating module 90 heats the water guided to the heating module 90 while generating preheating output power.

When approximately 0.6 to 1.8 sec elapses, the flow rate control valve 80 increases the flow rate to 430 gpm. When the flow rate control valve 80 increases the flow rate, the heating module 90 generates a fixed output power and heats water. When the flow rate starts to increase, the drain valve 120 may close the flow passage, and the hot water dispensing valve 110 may open the flow passage, such that hot water may be provided to the user.

The flow rate control valve 80 increases the flow rate to 430 gpm, but maintains the flow rate at 430 gpm for approximately 5 seconds after the target flow rate of 430 gpm is reached.

When approximately 8.2 sec elapses after the flow rate is increased by the flow rate control valve 80, the heating module 90 generates heat through PI control rather than at the fixed output power.

In addition, the flow rate control valve 80 reduces the target flow rate to 400 gpm, and allows water to be supplied to the heating module 90. Since the amount of water guided to the heating module 90 is reduced, the temperature of the hot water heated by the heating module 90 may increase. Therefore, the temperature of the hot water finally provided to the user may increase.

An embodiment according to FIGS. 9 and 10 will be described with reference to FIG. 12.

Figure 12:
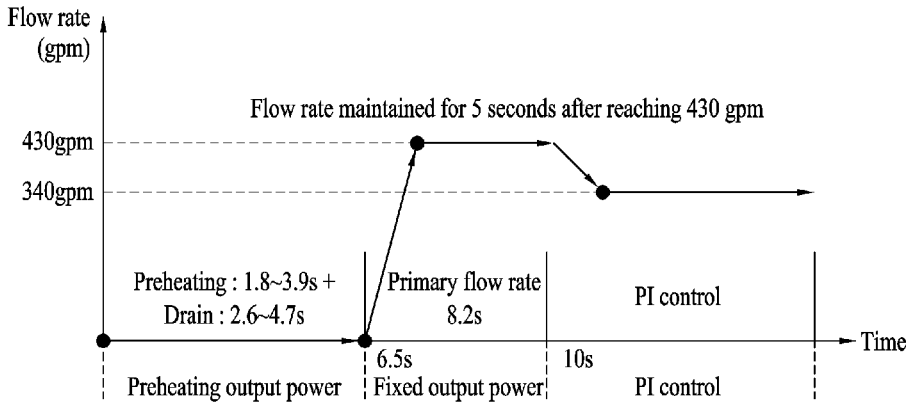
FIG. 12 illustrates an embodiment according to FIGS. 9 and 10.

In the method of FIG. 12, the operations illustrated in FIGS. 9 and 10 are implemented together. This is a case where the controller 200 determines that the corresponding dispensing is recurring dispensing and determines that the water re-dispensing time is beyond the second set time.

When the controller 200 determines that the corresponding dispensing is recurring dispensing, and the re-dispensing time of hot water is beyond the second set time, it may be difficult to supply hot water in a short time although the heating module 90 heats the water. That is, when hot water is provided to a user, there is a high possibility that the temperature of the hot water has not sufficiently risen.

Accordingly, the heating module 90 performs preheating for about 1.8 to 3.9 sec, and then the hot water heated by the heating module 90 is discharged through the drain valve 120 for about 2.6 to 4.7 sec.

At this time, the hot water dispensing valve 110 does not open the flow passage, and therefore hot water is not provided to the user but is discharged to the outside.

At the time of approximately 6.5 sec when the preheating and draining are completed, the heating module 90 is switched from the preheating output power to a fixed output power.

The flow rate control valve 80 increases the flow rate to 430 gpm. When the flow rate is increased, the output power of the heating module 90 may be switched to the fixed output power. In addition, at this time, the drain valve 120 may close the flow passage, and the hot water dispensing valve 110 may open the flow passage. Thus, hot water may start to be provided to the user.

When a predetermined time elapses since the time when the flow rate is increased to 430 gpm by the flow rate control valve 80, the flow rate may be reduced back to 340 gpm.

At the time when the flow rate control valve 80 maintains a constant flow rate or when the flow rate control valve 80 starts to lower the flow rate, the heating module 90 may be switched to be PI-controlled.

While the heating module 90 is implemented by PI control, the amount of water supplied to the heating module 90 may be reduced, and accordingly the temperature of the hot water that is finally provided to the user may be increased. Thereby, an effect of increasing the temperature of the hot water finally provided to the user may be obtained.

Figure 13:
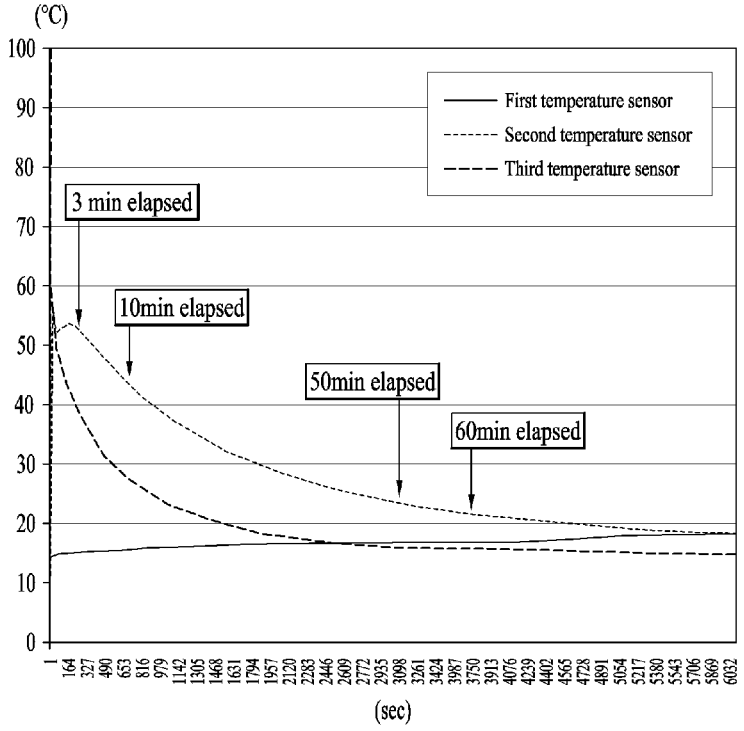
FIG. 13 depicts temperature change over time.

Temperature change over time will be described with reference to FIG. 13.

Temperature changes measured by the first temperature sensor 82, the second temperature sensor 92, and the third temperature sensor 112 after hot water is supplied to the user and then the operation is stopped will be discussed.

Since hot water has been provided to the user, each valve closes the flow passage through which the water moves, and the driving of the heating module 90 is stopped. Since the heating module 90 is turned off, water cannot be heated by the heating module 90.

It can be seen that water measured by the first temperature sensor 82 disposed in the flow rate control valve 80 is maintained at a temperature similar to the room temperature over time.

The temperature of water measured by the second temperature sensor 92 disposed in the heating module 90 is maintained to be higher than the temperature of water measured by the first temperature sensor 82 because of the residual heat in the heating module 90. However, when about 3 minutes elapses, the temperature rapidly decreases. Then, when about 60 minutes elapses, the temperature becomes substantially similar to the temperature measured by the first temperature sensor 82.

It can be seen that the temperature of water measured by the third temperature sensor 112 disposed in the hot water dispensing valve 110 maintains the highest temperature because the water is hot water immediately before being discharged to the user. The temperature of water may rapidly decrease over time.

Therefore, the inventors confirmed that when about 3 minutes elapses, the temperature of the water contained in the heating module 90 starts to decrease rapidly, and also concluded that when the user causes hot water to be dispensed within about 3 minutes, the temperature of hot water may be raised to a set temperature with a relatively small amount of heat. On the other hand, when the user causes hot water to be dispensed after about 3 minutes, the temperature of hot water may be raised to the set temperature with a relatively large amount of heat, and therefore the water is controlled to be slowly supplied to the heating module 90.

The present disclosure is not limited to the above-described embodiments. As can be seen from the appended claims, modifications and variations can be made by those of ordinary skill in the art to which the present disclosure belongs, and such modifications are within the scope of the present disclosure.

The invention claimed is:

1. A hot liquid supply apparatus comprising:

a flow rate control valve configured to adjust a flow rate of a liquid;

a heater configured to receive the liquid from the flow rate control valve to heat the liquid;

a hot liquid dispensing valve configured to open and close a first flow passage through which the liquid heated by the heater is discharged;

a pressure reducing valve that is provided at a second flow passage connecting the heater and the hot liquid dispensing valve, configured to lower a pressure of the liquid that is increased during heating of the liquid by the heater, and configured to open and close a flow passage through which liquid is discharged to outside without passing through the hot liquid dispensing valve; and a controller configured to control the flow rate control valve, the heater, the hot liquid dispensing valve, and the pressure reducing valve, wherein the controller adjusts the flow rate of the liquid supplied from the flow rate control valve to the heater while the hot liquid is being discharged.

2. The apparatus of claim 1, further comprising:

a drain valve provided the second flow passage connecting the heater and the hot liquid dispensing valve and configured to open and close a third flow passage through which the liquid is discharged to outside without passing through the hot liquid dispensing valve.

3. The apparatus of claim 2, wherein, upon determining that a first dispensing of the hot liquid is being performed during a time period, the controller controls at least one of the flow rate control valve, the heater, or the hot liquid dispensing valve such that the hot liquid is provided to a user using a first algorithm, and wherein, upon determining that the first dispensing of the hot liquid is not being performed during the time period, the controller controls at least one of the flow rate control valve, the heater, or the hot liquid dispensing valve such that the hot liquid is provided to the user using a second algorithm.

4. The apparatus of claim 3, wherein, when a temperature of the liquid supplied to the heater is lower than a set temperature, the controller determines that the first dispensing is being performed.

5. The apparatus of claim 3, wherein, when a temperature of the liquid measured at the heater is lower than a set temperature, the controller determines that the first dispensing is being performed.

6. The apparatus of claim 3, wherein, when a set time has elapsed after the heater was previously turned off, the controller determines that the first dispensing is being performed.

7. The apparatus of claim 3, wherein the first algorithm includes:

a preheating operation that includes driving the heater and heating the liquid while controlling the hot liquid dispensing valve to close the first flow passage.

8. The apparatus of claim 3, wherein the first algorithm includes:

a drain operation that includes controlling the drain valve to open the third flow passage to discharge the liquid to the outside while controlling the hot liquid dispensing valve to close the first flow passage.

9. The apparatus of claim 3, wherein the first algorithm includes:

a first supply operation that includes controlling the flow rate control valve to supply the liquid to the heater based on a first value for the flow rate;

a second supply operation that includes controlling the flow rate control valve to supply the liquid to the heater based on a second value for the flow rate after the first supply operation; and a third supply operation of supplying that includes controlling the flow rate control valve to supply the liquid to the heater based on a third value for the flow rate after the second supply operation.

10. The apparatus of claim 3, wherein the second algorithm includes:

a preheating operation that includes driving the heater and heating the liquid while controlling the hot liquid dispensing valve to close the first flow passage.

11. The apparatus of claim 3, wherein the second algorithm includes:

a drain operation that includes controlling the drain valve to open the third flow passage and discharging the liquid to the outside while controlling the hot liquid dispensing valve to close the first flow passage.

12. The apparatus of claim 9, wherein the second algorithm includes:

the first supply operation that includes controlling the flow rate control valve to supply the liquid to the heater based on the first value for the flow rate;

a fourth supply operation that includes controlling the flow rate control valve to supply the liquid to the heater based on a fourth value for the flow rate after the first supply operation, the fourth value being greater than the second value; and a fifth supply operation that includes controlling the flow rate control valve to supply the liquid to the heater based on a fifth value for the flow rate after the fourth supply operation, the fifth value being greater than the third value.

13. The apparatus of claim 1, further comprising:

a temperature sensor provided in the flow rate control valve.

14. The apparatus of claim 1, further comprising:

a temperature sensor provided in the heater.

15. The apparatus of claim 1, further comprising:

a temperature sensor provided in the hot liquid dispensing valve.

16. The apparatus of claim 3, further comprising:

an input device configured to receive a user input related to dispensing the liquid, wherein the controller is further configured to determine whether the first dispensing is being performed based on the user input.

17. A hot liquid supply apparatus comprising:

a flow rate control valve configured to adjust a flow rate of a liquid;

a heater configured to receive the liquid from the flow rate control valve to heat the liquid;

a hot liquid dispensing valve configured to open and close a first flow passage through which the liquid heated by the heater is discharged;

a pressure reducing valve that is provided in a flow passage connecting the heater module and the hot liquid dispensing valve, configured to lower a pressure of the liquid that is increased during heating of the liquid by the heater, and configured to open and close a flow passage through which liquid is discharged to outside without passing through the hot liquid dispensing valve; and a controller configured to control the flow rate control valve, the heater, the hot liquid dispensing valve, and the pressure reducing valve, wherein the controller is further configured to:

determine whether a first dispensing of the hot liquid is being performed during a time period, control at least one of the flow rate control valve, the heater, or the hot liquid dispensing valve such that the hot liquid is provided to a user using a first algorithm when the first dispensing of the hot liquid is being performed, and control at least one of the flow rate control valve, the heater, or the hot liquid dispensing valve such that the hot liquid is provided to the user using a second algorithm when the first dispensing of the hot liquid is not being performed during the time period, and wherein the controller determines at least one value for the flow rate of the flow rate control valve based on whether the first algorithm or the second algorithm is being used.

18. The apparatus of claim 17, wherein the first algorithm includes:

controlling the flow rate control valve to supply the liquid to the heater based on a first value for the flow rate during a first time period, controlling the flow rate control valve to supply the liquid to the heater based on a second value for the flow rate during a second time period after the first time period, the second value being greater than the first value, and controlling the flow rate control valve to supply the liquid to the heater based on a third value for the flow rate during a third time period after the second time period, the third value being less than the second value.

19. The apparatus of claim 18, wherein the second algorithm includes:

controlling the flow rate control valve to supply the liquid to the heater based on the first value for the flow rate during the first time period, controlling the flow rate control valve to supply the liquid to the heater based on a fourth value for the flow rate during the second time period, the fourth value being greater than the second value, and controlling the flow rate control valve to supply the liquid to the heater based on a fifth value for the flow rate during the third time period, the fifth value being greater than the fourth value.

20. The apparatus of claim 17, wherein the controller is further configured to determine that the first dispensing is being performed when a temperature of the liquid supplied to the heater is lower than a first set temperature, a temperature of the liquid measured at the heater is lower than a second set temperature, and a set time has elapsed after the heater was previously turned off.

* * * * *